US008295520B2

(12) United States Patent
Korl et al.

(10) Patent No.: US 8,295,520 B2
(45) Date of Patent: Oct. 23, 2012

(54) METHOD FOR DETERMINING A MAXIMUM GAIN IN A HEARING DEVICE AS WELL AS A HEARING DEVICE

(75) Inventors: Sascha Korl, Schoenenberg (CH); Lukas Kuhn, Grafenried (CH)

(73) Assignee: Phonak AG, Stafa (CH)

( * ) Notice: Subject to any disclaimer, the term of this patent is extended or adjusted under 35 U.S.C. 154(b) by 295 days.

(21) Appl. No.: 12/864,032

(22) PCT Filed: Jan. 22, 2008

(86) PCT No.: PCT/EP2008/050701

§ 371 (c)(1), (2), (4) Date: Jul. 22, 2010

(87) PCT Pub. No.: WO2008/065209

PCT Pub. Date: Jun. 5, 2008

(65) Prior Publication Data

US 2010/0296680 A1 Nov. 25, 2010

(51) Int. Cl.
*H04R 25/00* (2006.01)

(52) U.S. Cl. ..... 381/318; 381/312; 381/316; 381/321

(58) Field of Classification Search ..... 381/312–321
See application file for complete search history.

(56) References Cited

U.S. PATENT DOCUMENTS

| | | | | |
|---|---|---|---|---|
| 6,072,884 | A * | 6/2000 | Kates | 381/318 |
| 6,347,148 | B1 * | 2/2002 | Brennan et al. | 381/318 |
| 6,876,751 | B1 * | 4/2005 | Gao et al. | 381/318 |
| 2001/0002930 | A1 | 6/2001 | Kates | |
| 2004/0066946 | A1 | 4/2004 | Buol | |
| 2005/0207583 | A1 * | 9/2005 | Christoph | 381/57 |
| 2006/0291681 | A1 * | 12/2006 | Klinkby et al. | 381/318 |

FOREIGN PATENT DOCUMENTS

| | | | |
|---|---|---|---|
| WO | 0225996 | A1 | 3/2002 |
| WO | 2007125132 | A2 | 11/2007 |

OTHER PUBLICATIONS

International Search Report for PCT/EP2008/050701 dated Oct. 20, 2008.

* cited by examiner

*Primary Examiner* — Mohamad Musleh
*Assistant Examiner* — Mangtin Lian
(74) *Attorney, Agent, or Firm* — Pearne & Gordon LLP

(57) ABSTRACT

A method for determining a maximum gain is disclosed that is applicable in a forward signal path starting at a microphone (1) and ending at a receiver (11) of a hearing device, the maximum gain being a gain value at which just no feedback occurs. The method comprising the steps of estimating a estimated feedback transfer function (F') characterizing a feedback signal path (15) starting at a receiver (11) and ending at a microphone (1) of the hearing device, while the hearing device is inserted into an ear of a hearing device user, and adapting the estimated feedback transfer function (F') as a result of a changing feedback signal path (15) by applying an adaptive algorithm. The invention is characterized by determining the maximum gain from the estimated feedback transfer function (F'), in particular by coefficients of the estimated feedback transfer function.

24 Claims, 3 Drawing Sheets

METHOD FOR DETERMINING A MAXIMUM GAIN IN A HEARING DEVICE AS WELL AS A HEARING DEVICE

The present invention is related to a method for determining a maximum gain in a hearing device according to the pre-amble of claim 1 as well as to a hearing device according to the pre-amble of claim 8.

The feedback stability of a hearing device is a crucial variable in the fitting of the hearing device to the users hearing loss and hearing preferences. The feedback stability depends on a couple of factors, e.g. the acoustic path from the receiver back to the microphone, including ear geometry, type of ear shell, vent size, tubing, etc., the mechanical stability of the hearing device housing, especially the mechanical coupling between receiver and microphones, and electromagnetic couplings.

Hence, the fitting software offers (or requires) to test the feedback stability with a feedback test. Different methods are known to perform this task:

A first method is called "Direct Method" and is implemented by increasing the gain in every frequency band until the system becomes unstable. The gain at which just no feedback occurs is then used as the maximum gain in the corresponding frequency band.

A second method is called "Negative-Slope Method" and is described in U.S. Pat. No. 7,010,135 B2. The known technique uses a gain curve (i.e. gain vs. input level) having a negative slope in each band. Because of a high gain at a low input signal, feedback is forced by increasing the input level. As a result thereof, the gain decreases until a stable state is reached. The gain at this stable point is the maximum stable gain, i.e. the feedback threshold.

A third method is called "Open-Loop Identification" and is, for example, described in the publication entitled "Adaptive Filter Theory" by S. Haykin (Prentice Hall, 1996). The loop consisting of a signal processing unit in the hearing device and the feedback path is opened. While applying a probe signal at the output of the signal processing unit of the hearing device, the response at the input of the signal processing unit is measured. By way of correlation (or adaptive filtering) the feedback threshold can be determined. Robustness against environment sound can be achieved through longer averaging times and pseudo-noise techniques.

A fourth method is called "Closed-Loop Identification": While the hearing device is in normal operation, a probe signal is preferably injected at the output of the hearing device. The identification techniques are the same as for the third method described above. The accuracy is though lower, because of the closed-loop operation. Consequently, the signal level of a necessary probe signal has to be rather high so that it is often perceived as uncomfortably loud.

A fifth method is called "Starkey Destiny" and is disclosed in a paper entitled "Active Feedback Intercept" by S. Banerjee (Starkey White Paper, 2006). A self-learning of a feedback canceller initialization is mentioned. But in the fitting software that is used to adjust a hearing device, a feedback test with a probe signal has to be done in order to activate the feedback canceller. No other information is disclosed in relation to self-learning features.

The known techniques have at least one of the following drawbacks:

- An interruption of normal operation of the hearing device is necessary.
- An explicit measurement is necessary, i.e. an action is required by the fitter.

- Because of high signal levels that occur during the feedback test, the hearing device user is discomforted during the feedback test.
- An adaptation to slowly changing feedback conditions due to a reduced fit of the ear shell, due to dirt in the vent, at the receiver sound outlet or on the microphone cover element, etc. is not possible.
- The addition of the level of noise and gain is less than the maximum power output.
- A principal susceptibility to an environment noise level must be accepted.

It is therefore one object of the present invention to provide a method for determining a maximum gain in a hearing device, which method does at least not have one of the above-mentioned disadvantages.

This and other objects are accomplished by the measures specified in the characterizing part of claim 1. Additional embodiments of the present invention as well as a hearing device are specified in further claims.

A second problem that can be solved by the invention is the adaptation of this once measured feedback stability over time during the everyday use of the hearing device. The invention allows tracking the long-term changes of the feedback stability.

The present invention is further explained in more detail by referring to drawings illustrating exemplified embodiments of the present invention.

FIG. 1 schematically shows a block diagram of a known hearing device.

FIG. 2 schematically shows a block diagram of a hearing device with an extraction unit according to the present invention.

Figure 1:
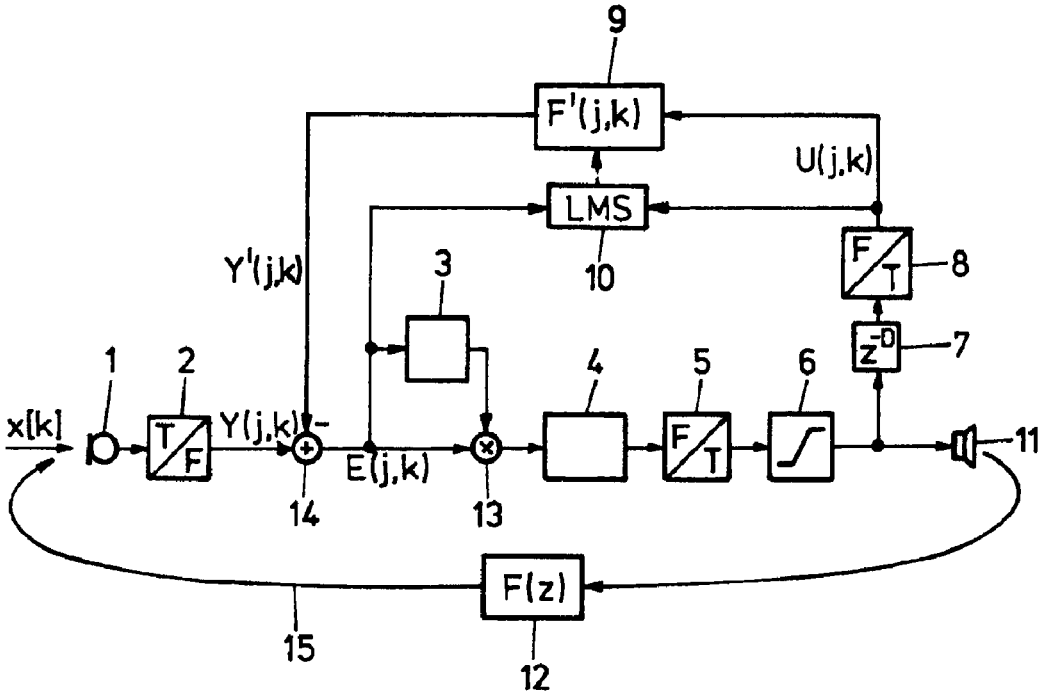

FIG. 1 shows a block diagram of a known hearing device with a forward signal path comprising a microphone 1, a time-to-frequency domain transfer unit 2, a gain unit 3, a shift unit 4, a frequency-to-time domain transfer unit 5, a limiting unit 6 and a loudspeaker 11, often called receiver in the technical field of hearing devices. In addition to the forward signal path, a feedback signal path 15 is indicated comprising a feedback transfer unit 12 with a feedback transfer function F(z). The feedback signal path 15 represents an acoustic path that starts at the receiver 11 and ends at the microphone 1. The feedback transfer function F(z) is not known a priori and depends on the ear geometry, type of ear shell, vent size, tubing, mechanical couplings, etc. As has been pointed out in the introductory part, the feedback transfer function F(z) has a direct influence on the maximum gain that can be adjusted in the hearing device, i.e. in the gain unit 3.

For determining a maximum gain that is adjusted in the gain unit 3, the feedback transfer function F(z) is estimated using an adaptive filter. In fact, the feedback transfer function F(z) in the feedback signal path 15 is estimated to obtain an estimated feedback transfer function F'(j, k). Thereto, the very well known technique for adaptive feedback canceller is applied using a LMS-(Least Mean Square)-algorithm for minimizing the error of the adaptation.

The LMS-algorithm is implemented in a LMS unit 10, to which the delayed output signal U(j, k) of the limiting unit 6 is fed via a further frequency-to-time domain transfer unit 8. In addition, a difference signal E(j, k), which is fed to the gain unit 3 as well as to an addition unit 13, is also inputted to the LMS unit 10. From the two input signals, coefficients for the estimated feedback path transfer function F'(j, k) can be calculated. As long as the output signal E(j, k) contains a portion of the feedback signal of the feedback signal path 15, the estimation of the estimated feedback path transfer function F'(j, k) can be further improved.

The estimated feedback path transfer function F'(j, k) or $F_j[k]$ mimics the external feedback path 15—i.e. its transfer function F(z)—and can therefore be described by its coefficients, which are called FC coefficients hereinafter. It is pointed out that the adaptive filter can be implemented in the frequency or in the time domain.

The FC coefficients are updated with a fast tracking speed with the adaptive filter algorithm. The movement of the FC coefficients follows each change in the feedback path and also possesses natural fluctuations. In addition, the adaptive filter algorithm is not perfect such that temporarily misadjusted FC coefficients may follow. This is especially true if the loop gain is low, which will be further explained in more detail below.

The shift unit 4 is used to prevent a correlation between the error signal E(j, k) and the signal U(j, k) and basically is a frequency shifter as known, for example, from the paper entitled "Adaptive feedback cancellation with frequency compression for hearing aids" by Harry Alfonso L. Joson et al. (J. Accoust. Soc. Am. 94 (6), December 1993, pp. 3248-3254).

The use of the shift unit 4 further stabilizes the operation of the adaptive filter such that the resulting FC coefficients are less erroneous.

Figure 2:
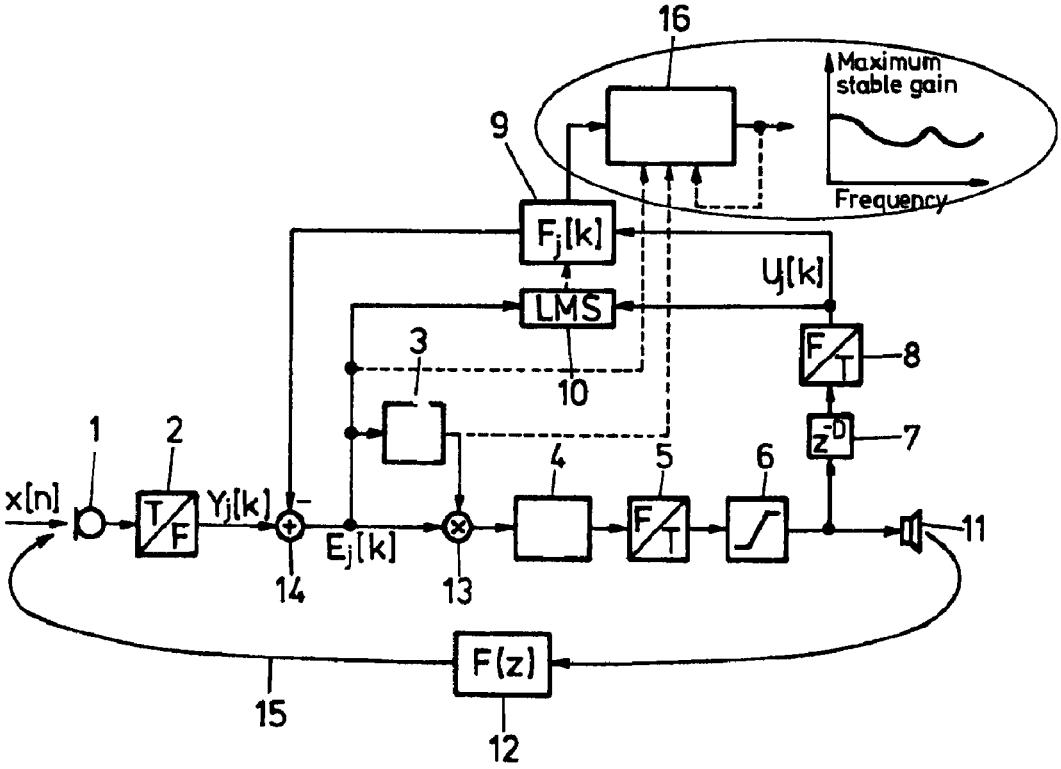

FIG. 2 shows a block diagram of a hearing device according to the present invention. In addition to the blocks shown in FIG. 1, an extraction unit 16 is provided, in which the maximum gain is determined that can be applied in the gain unit 3.

Figure 3:
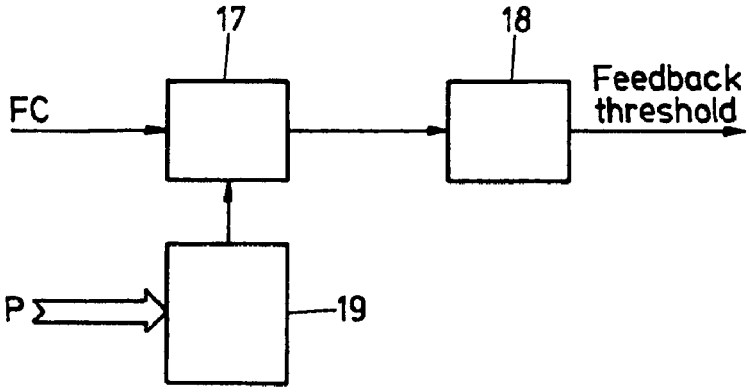
FIG. 3 shows a block diagram of a first embodiment of the extraction unit according to FIG. 2.

In FIG. 3, the extraction unit 16 of FIG. 2 is depicted in more detail. The FC coefficients of the extraction unit 16 (FIG. 2) are fed to a preprocessing unit 17 that is connected to a conversion unit 18. The conversion unit 18 determines a feedback threshold or maximum gain that is adjusted in the gain unit 3 (FIG. 2). In addition, a control unit 19 is provided, which is fed by further parameters P taken into account while determining the feedback threshold and maximum gain, respectively. The further parameters P are also used to optimize the determination of the feedback threshold and maximum gain, respectively.

The further parameters P might be one or several of the following:

input level at the microphone 1 of the hearing device;

momentary gain value of the gain unit (3);

predefined gain value of the gain unit (3).

In a first embodiment of the present invention, the preprocessing unit 17 is used to smooth FC coefficient fluctuations, i.e. an averaging of the FC coefficients is performed in the preprocessing unit 17 in order to get rid of fast changing FC coefficients.

The averaged FC coefficients $F_j[k]$, wherein j is the frame number and k is the frequency bin, can be seen as a frequency-domain representation, or the averaged FC coefficients $f_t[n]$, wherein t is the time and n is the filter time lag, can be seen as a time-domain representation of the estimated frequency transfer function F'(j, k) (FIG. 1). The maximum stable gain the hearing device can achieve for an estimated frequency transfer function F'(j, k) is determined by the conversion unit 18.

In a further embodiment of the present invention, the maximum gains may have to be known in terms of specific frequency bands (e.g. on the Bark scale). The conversion from frequency-domain or time-domain FC coefficients to frequency bands is also done by the conversion unit 18.

A possible processing performed in the conversion unit 18 can be performed using the following formulas:

In time domain:

$$\mathrm{MSG}_t^{dB}[b] = -F2B\{10\log(|FFT\{f_t[\bullet]\}|^2)\}$$

In frequency domain:

$$\mathrm{MSG}_j^{db}[b] = -F2B\{10\log(|F_j[k]|^2)\}$$

where MSG is an acronym for Maximum Stable Gain and F2B denotes the conversion from frequency bins to Bark bands, wherein a so-called Bark band comprises a collection of adjacent frequency bins. The operation performed on a collection of frequency bins is, for example, an operation to obtain a maximum of the values of specified frequency bins in a Bark band according the following formula, for example:

$$F2B\{F[k]\} = \max_{k=l_b \ldots h_b} F[k]$$

where $l_b$ and $h_b$ are the lower and upper border of Bark band b. Other operations, such as mean or median, are also possible.

Although FIG. 2 shows an embodiment implemented in the frequency domain, the present invention is not restricted to the frequency domain but can readily be implemented in the time domain or together with a time domain feedback canceller, respectively.

The control unit 19 steers the preprocessing of the FC coefficients in the preprocessing unit 17. The means of steering comprises a possible freezing of the running preprocessing, an adjustment of the time constants of the preprocessing as well as a (time-dependent) weighting of the FC coefficients prior to the preprocessing.

The preprocessing may be frozen if the (variable) gain in the gain unit 3 is too low, if the difference to the theoretical feedback threshold is too high or if the hearing device is not in operation, which may be detected by an automatic detection unit (not shown in FIG. 3).

As has been mentioned above, an averaging of the FC coefficients is performed in the preprocessing unit 17 in one embodiment. In a further embodiment, the preprocessing unit 17 comprises a decision unit that decides, when the preprocessing, for example the averaging of FC coefficients, is to be activated and when frozen, or how the time-constant for the preprocessing is adapted. In another embodiment, a dependency on the prescribed gain is taken into account during the preprocessing step. In still another embodiment, the input level of the acoustic signal is consulted for controlling the preprocessing. In a further embodiments, the variance or the histogram of the FC coefficients are analyzed as well as certain measures derived thereof, as for example percentiles by using dual-slope averaging.

Figure 4:
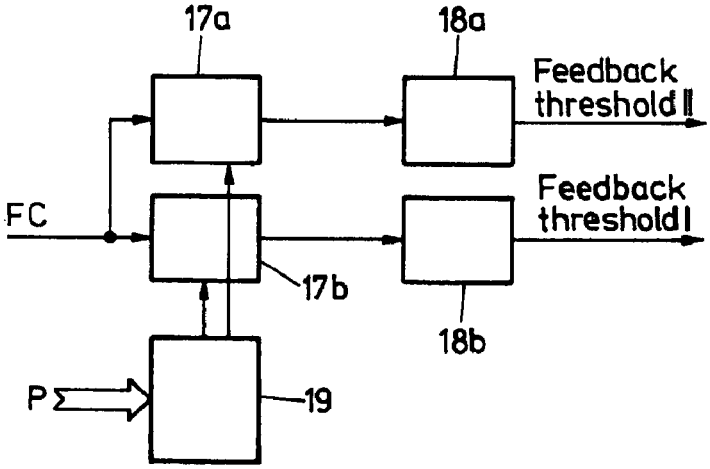
FIG. 4 shows a block diagram of a second embodiment of the extraction unit according to FIG. 2.

In FIG. 4, a further embodiment of the extraction unit 16 (FIG. 2) is depicted. Instead of one preprocessing unit 17 as shown in FIG. 3, two preprocessing units 17*a* and 17*b* and corresponding conversion units 18*a* and 18*b* are used to independently determine feedback thresholds. The control unit 19 is connected to both conversion units 18*a* and 18*b* in order to control the behavior of the conversion units 18*a* and 18*b*. A possible application of such a dual extraction system might be used when one preprocessing unit 17*a* with the corresponding conversion unit 18*a* is used for a first hearing program, for example for a general acoustic situation, while the other preprocessing unit 17*b* with the corresponding conversion unit 18*b* is used for a second hearing program, for example for a telephone situation. Therefore, the control unit 19 is designed to switch between the two preprocessing units 17*a*, 17*b* and the corresponding conversion unit 18*a*, 18*b* in order to obtain the correct maximum gain and feedback threshold, respectively.

Figure 5:
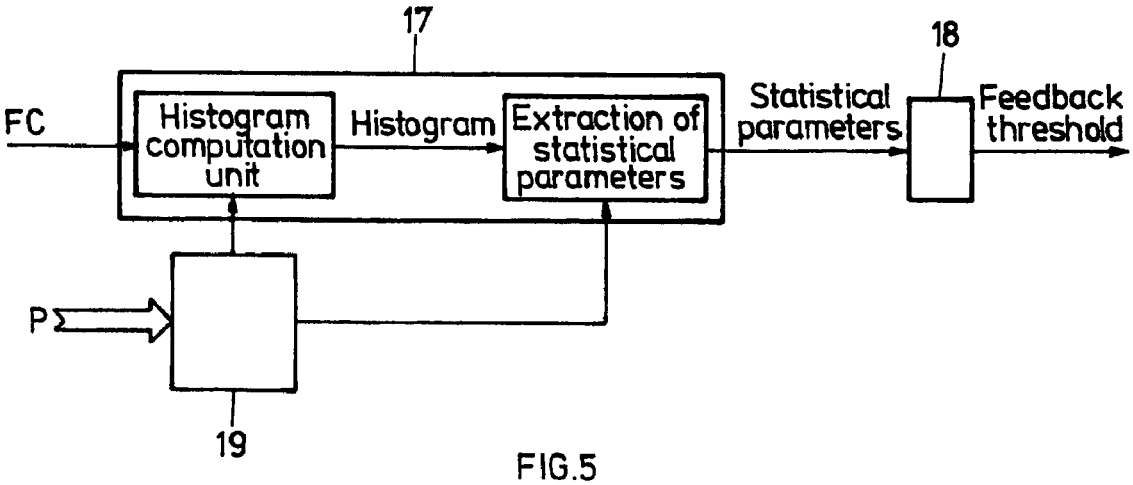
FIG. 5 shows a block diagram of a third embodiment of the extraction unit according to FIG. 2.

In a further embodiment of the present invention, the extraction unit 16 (FIG. 2) is implemented as depicted in FIG. 5. In contrast to other mentioned embodiments, a histogram of the FC coefficients is computed in the preprocessing unit 17 as well as statistical parameters (e.g. percentiles, variance, number of peaks, etc.) derived from the histogram. Of these parameters, the variance may serve as indicator for the accuracy of the measurement, for example.

It is pointed out that an important aspect and advantage of the present invention is that it can be used during regular operation of the hearing device. Nevertheless, the present invention can also be used during a fitting session, during which an audiologist adjusts a hearing device for a later regular use by the hearing device user. While predefined probe signals are presented to the hearing device user having inserted his hearing device during a fitting session in order to adjust the hearing device, in particular the maximum gain and the threshold level, respectively, the hearing device is continuously adjusted during regular operation using the acoustic signals that are presented during every day usage to the hearing device user. In both applications, there is no need to interrupt regular operation, nor is it necessary to present a certain probe signal.

Figure 6:
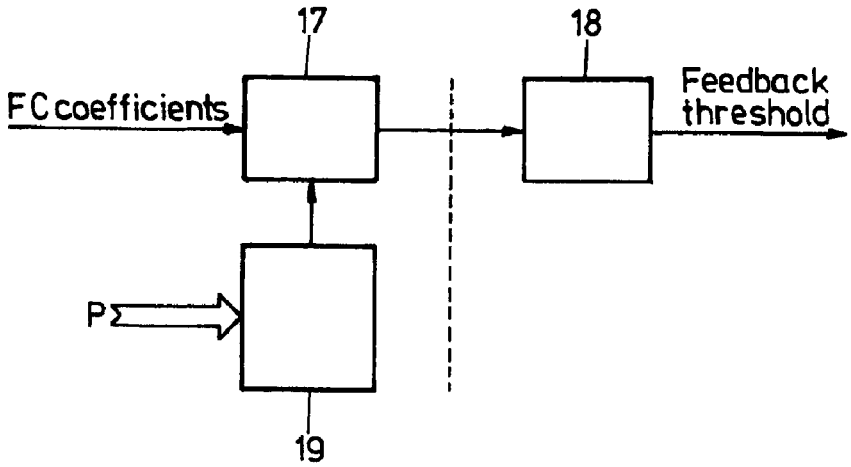
FIG. 6 shows the block diagram of the first embodiment of the extraction unit being partially realized outside a hearing device.

FIG. 6 shows the embodiment of the extraction unit 16 as has been shown in FIG. 3. In addition to the block diagram shown in FIG. 3, a dashed line is inserted in FIG. 6 to indicate the possibility to implement the control unit 19 and the preprocessing unit 17 in the hearing device while the conversion unit 18 is implemented in an external calculation unit, as for example in a personal computer, which is designed to read out the FC coefficients preprocessed in the preprocessing unit 17 in order to complete the calculation, namely the determination of the maximum gain and threshold level, respectively, in the calculation unit. In practice, the calculation unit will be the personal computer to which the hearing device is hooked up either via a wired or via a wireless connection to the fitter's personal computer.

Figure 7:
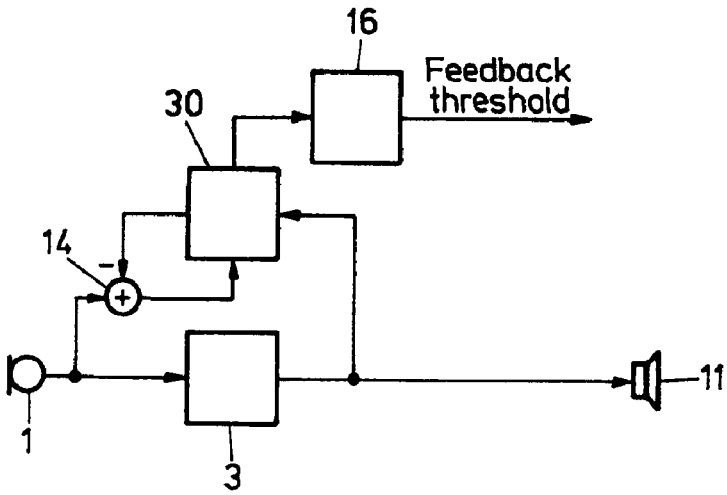
FIG. 7 shows a simplified block diagram of an inventive hearing device that does not automatically adjust a gain in a main signal path of the hearing device.

FIG. 7 shows a simplified block diagram of a further embodiment of the present invention in that a hearing device is depicted comprising a microphone 1, a gain unit 3, an adaptive filter unit 30, a receiver 11 and a extraction unit 16. In contrast to the concept implemented in the embodiment according to FIG. 2, the input signal of the hearing device is not adapted by the adaptive filter unit 30. In fact, the adaptive filter unit 30 is run in the background in the embodiment according to FIG. 7. Although the input signal is not adapted by the adaptive filter unit 30, the adaptive filter unit 30 nevertheless adjusts the FC coefficients such that a feedback threshold can be extracted.

This embodiment can be used, for example, if feedback threshold estimation is desired before the feedback canceller is activated.

Figure 8:
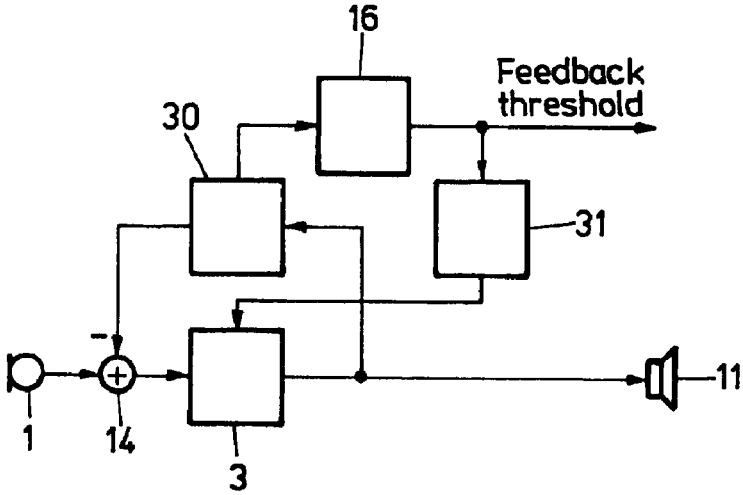
FIG. 8 shows a simplified block diagram of an inventive hearing device that automatically adjusts the gain in the main signal path of the hearing device.

FIG. 8 shows an embodiment, in which the gain of the gain unit 3 is adjusted within the limits of maximum gain and threshold level, respectively, determined by the extraction unit 16. Thereto, a gain adjustment unit 31 is provided that is connected in-between the extraction unit 16 and the gain unit 3 in order to automatically adjust the gain such that the loop-gain is, for example, approximately at −5dB, where a desired accuracy of the estimation is achieved. The gain adjustment can thereby be performed stepwise or continuously.

The first use case is as replacement of state-of-the-art feedback threshold estimation methods. The feedback threshold is measured during the fitting session in order to set maximal gains such that the hearing instrument operates in a stable condition. Other optimizations depending on the measured feedback threshold are possible.

Described method can also be used during every-day operation of the hearing instrument. In this use case, the hearing instrument measures the hearing threshold continuously. This continuously measured feedback threshold may be readout by the fitting software in the following fitting session and used as information for the fitter, who can make adjustments based on the continuously measured feedback threshold.

The measured feedback threshold can also be used to adjust parameters of the hearing instrument online and automatically, e.g. reduce the maximum gain if the feedback threshold has worsened.

What is claimed is:

1. A method for determining a maximum gain that is applicable in a forward signal path starting at a microphone and ending at a receiver of a hearing device, the maximum gain being a gain value at which just no feedback occurs, the method comprising the steps of:

estimating an estimated feedback transfer function characterizing a feedback signal path starting at a receiver and ending at a microphone of the hearing device, while the hearing device is inserted into an ear of a hearing device user, adapting the estimated feedback transfer function as a result of a changing feedback signal path by applying an adaptive algorithm, determining the maximum gain from the estimated feedback transfer function, whereby taking into account further parameters while determining the maximum gain, the further parameters being at least one of the following:

an input level at the microphone of the hearing device;

a momentary gain value applied in the forward signal path;

a predefined gain value applied in the forward signal path;

a pre-calculated maximum gain value that is based on standard values, particularly providing information about type of hearing device or used ear shell;

a current value of the estimated frequency transfer function;

a variance of the coefficients of the estimated feedback transfer function;

a histogram of the coefficients of the estimated feedback transfer function;

statistical parameters derived from the histogram;

predefined point in time.

2. The method of claim 1, wherein the step of determining the maximum gain comprises:

extracting coefficients of the estimated feedback transfer function, averaging coefficients of the estimated feedback transfer function over time to obtain smoothed coefficients, and determining the maximum gain from the smoothed extracted coefficients.

3. The method of claim 1, further comprising the step of adjusting a gain in the forward signal path of the hearing device in accordance with the determined maximum gain.

4. The method of claim 3, further comprising the step of interrupting the step of adjusting the gain in the forward signal path of the hearing device in case at least one of the following conditions is met:

the determined gain is below a predetermined gain;

a difference between a maximal feedback gain and the determined gain is above a predetermined value;

the hearing device is not in operation.

5. The method of claim 1, further comprising the step of determining a maximum gain that is applicable in the forward signal path of the hearing device for every selectable hearing program in the hearing device in order to readily adapt to different hearing programs.

6. The method of claim 1, further comprising the step of continuously measuring and recording the maximum gain.

7. The method of claim 1, further comprising the step of applying the adaptive algorithm in background in that no feedback compensation takes place in the forward signal path.

8. A hearing device with a forward signal path comprising a microphone, a gain unit and a receiver, and with an adaptive filter comprising an estimated feedback path unit, an LMS unit and a subtraction unit, the LMS unit being operationally connected to the estimated feedback path unit, an output signal of the gain unit being operationally connected to the LMS unit, to the estimated feedback path unit as well as to the receiver, an output of the estimated feedback path unit being operationally connected to a first input signal of the subtraction unit, while an output signal of the microphone being operationally connected to a second input signal of the subtraction unit in order that the output signal of the estimated feedback path unit is subtracted from the output signal of the microphone, an output of the subtraction unit being operationally connected to the gain unit, wherein the estimated feedback path unit is operationally connected to an extraction unit, by which a maximum gain is determined at which just no feedback occurs, wherein further parameters are taken into account while determining the maximum gain, the further parameters being at least one of the following:

an input level at the microphone of the hearing device;

a momentary gain value applied in the forward signal path;

a predefined gain value applied in the forward signal path;

a pre-calculated maximum gain value that is based on standard values, particularly providing information about type of hearing device or used ear shell;

a current value of the estimated frequency transfer function;

a variance of the coefficients of the estimated feedback transfer function;

a histogram of the coefficients of the estimated feedback transfer function;

statistical parameters derived from the histogram;

predefined point in time.

9. The hearing device of claim 8, wherein the extraction unit comprises means for extracting coefficients of an estimated feedback transfer function estimated in the feedback path unit.

10. The hearing device of claim 8, wherein the extraction unit comprises a preprocessing unit for extracting coefficients of the estimated feedback transfer function and a conversion unit for determining the maximum gain from the extracted coefficients.

11. The hearing device of claim 8, wherein the extraction unit is operationally connected to the gain unit.

12. The hearing device of claim 8, further comprising a control unit that is operationally connected to the extraction unit.

13. The hearing device of claim 12, wherein the control unit comprises means for interrupting of adjusting a gain in the forward signal path in case at least one of the following conditions is met:

the determined gain is below a predetermined gain;

a difference between a maximal feedback threshold and the determined gain is above a predetermined value;

the hearing device is not in operation.

14. The hearing device of claim 8, further comprising means for determining a maximum gain that is applicable in the forward signal path of the hearing device for every selectable hearing program in the hearing device in order to readily adapt to different hearing programs.

15. The hearing device of claim 8, further comprising means for continuously measuring and recording the maximum gain.

16. A hearing device comprising:

a microphone, a gain unit, an adaptive filter unit, a receiver, an extraction unit and a subtraction unit, wherein an output signal of the microphone is operationally connected to an input of the gain unit which is operationally connected to the receiver as well as to the adaptive filter unit, a first output of the adaptive filter unit being operationally connected to a first input signal of the subtraction unit, while the output of the microphone being operationally connected to a second input signal of the subtraction unit in order that the output signal of the adaptive filter unit is subtracted from the output signal of the microphone, an output signal of the subtraction unit being operationally connected to the adaptive filter unit, and wherein a second output signal of the adaptive filter unit is operationally connected to the extraction unit, in which a maximum gain is determined at which just no feedback occurs.

17. The hearing device of claim 16, wherein further parameters are taken into account while determining the maximum gain, the further parameters being at least one of the following:

an input level at the microphone of the hearing device;

a momentary gain value applied in the forward signal path;

a predefined gain value applied in the forward signal path;

a pre-calculated maximum gain value that is based on standard values, particularly providing information about type of hearing device or used ear shell;

a current value of the estimated frequency transfer function;

a variance of the coefficients of the estimated feedback transfer function;

a histogram of the coefficients of the estimated feedback transfer function;

statistical parameters derived from the histogram;

predefined point in time.

18. The hearing device of claim 16, wherein the extraction unit comprises means for extracting coefficients of an estimated feedback transfer function estimated in the adaptive filter unit.

19. The hearing device of claim 18, wherein the extraction unit comprises a preprocessing unit for extracting coefficients of the estimated feedback transfer function and a conversion unit for determining the maximum gain from the extracted coefficients.

20. The hearing device of claim 16, wherein the extraction unit is operationally connected to the gain unit.

21. The hearing device of claim 16, further comprising a control unit that is operationally connected to the extraction unit.

22. The hearing device of claim 21, wherein the control unit comprises means for interrupting of adjusting a gain in the gain unit in case at least one of the following conditions is met:

the determined gain is below a predetermined gain;

a difference between a maximal feedback threshold and the determined gain is above a predetermined value;

the hearing device is not in operation.

23. The hearing device of claim 16, further comprising means for determining a maximum gain that is applicable in the gain unit for every selectable hearing program in the hearing device in order to readily adapt to different hearing programs.

24. The hearing device of claim 16, further comprising means for continuously measuring and recording the maximum gain.

* * * * *